US005983815A

United States Patent [19]

Card

[11] Patent Number: 5,983,815

[45] Date of Patent: Nov. 16, 1999

[54] TUFTING MACHINE WITH PATTERN YARN FEED AND DISTRIBUTION DEVICE

[75] Inventor: Roy T. Card, Chattanooga, Tenn.

[73] Assignee: Card-Monroe Corp., Chattanooga, Tenn.

[21] Appl. No.: 09/038,042

[22] Filed: Mar. 10, 1998

Related U.S. Application Data

[60] Provisional application No. 60/036,681, Mar. 11, 1997.

[51] Int. Cl.[6] ..... D05C 15/18

[52] U.S. Cl. ..... 112/80.73

[58] Field of Search ..... 112/80.23, 80.7, 112/80.73, 163, 302

[56] References Cited

U.S. PATENT DOCUMENTS

| | | | |
|---|---|---|---|
| 2,862,465 | 12/1958 | Card . | |
| 3,067,701 | 12/1962 | Wilcox | 112/80.73 X |
| 3,075,482 | 1/1963 | Card . | |
| 3,084,645 | 4/1963 | Card . | |
| 3,847,098 | 11/1974 | Hammel, Jr. | 112/80.73 |
| 4,193,358 | 3/1980 | Woodcock | 112/80.73 X |
| 4,393,793 | 7/1983 | Beasley . | |
| 4,688,497 | 8/1987 | Card et al. | 112/80.73 |
| 4,864,946 | 9/1989 | Watkins | 112/80.73 |
| 5,182,997 | 2/1993 | Bardsley | 112/80.73 |
| 5,383,415 | 1/1995 | Padget, III . | |
| 5,544,605 | 8/1996 | Frost | 112/475.23 |
| 5,588,383 | 12/1996 | Davis et al. | 112/80.16 |

FOREIGN PATENT DOCUMENTS

| | | |
|---|---|---|
| 780370 | 9/1955 | United Kingdom . |
| 1126549 | 9/1968 | United Kingdom . |
| 1363974 | 8/1974 | United Kingdom . |
| 1507166 | 5/1975 | United Kingdom . |
| 2002040 | 7/1978 | United Kingdom . |
| 2002828 | 2/1979 | United Kingdom . |
| 2319786 | 6/1998 | United Kingdom . |

*Primary Examiner*—Ismael Izaguirre

*Attorney, Agent, or Firm*—Womble Carlyle Sandridge & Rice, PLLC

[57] ABSTRACT

A tufting machine with an improved pattern yarn feed and distribution device for use in tufting a graphic pattern into the face of a tufted article. An improved pattern yarn feed drive is provided with at least two separate yarn drive control sections which together provide an increased number of controls such that any one control is adapted to drive a predetermined number of tufting yarns selectively passed thereabout for minimizing the length between any one of the tufting yarns and its respective tufting needle. An improved tube bank configuration is used with the pattern yarn drive assembly, and comprises at least two tube bank sections, each of which is also constructed and arranged to minimize the length of the yarns passed therethrough from a respective one of the yarn drive controls to a respective one of the tufting needles. This improved construction minimizes the problems of yarn elasticity and yarn lag when feeding the yarns to the needles of the tufting machine, thus greatly reducing the likelihood of a loss of pattern definition occurring in the graphic pattern being tufted in the face of the tufted article on the tufting machine.

18 Claims, 8 Drawing Sheets

LOWER COLLECTOR REPEAT DETAIL

| | SECTIONS | | | | | | | | | |
|---|---|---|---|---|---|---|---|---|---|---|
| 67-72 SECTION A | 1-72 SECTION A&B | 1-72 SECTION A&B | 1-72 SECTION B&C | 1-72 SECTION B&C | 1-72 SECTION B&C | 1-72 SECTION B&C | 1-72 SECTION C&D | 1-72 SECTION C&D | 0-6 SECTION D |
| SELVEDGE | 1 | 2 | 3 | 4 | 5 | 6 | 7 | 8 | 9 | SELVEDGE |
| | REPEAT | | | | | | | | | |

TUFTING MACHINE WITH PATTERN YARN FEED AND DISTRIBUTION DEVICE

CROSS REFERENCE TO RELATED APPLICATION

This Patent application claims the benefit of, and priority to U.S. Provisional Patent Application No. 60/036,681 filed in the United States Patent and Trademark Office on Mar. 11, 1997.

FIELD OF THE INVENTION

This invention relates in general to tufting machines. More particularly, this invention relates to an improved tufting machine pattern yarn feed device and yarn distribution tube bank for feeding and distributing a series of yarns of the tufting machine to the needles of the tufting machine, and more specifically to each needle within each repeat of needles disposed in spaced series along the needle bar of the tufting machine.

BACKGROUND OF THE INVENTION

The use of tufting machines to create tufted articles, for example tufted carpet, is well known in the art. Conventional tufting machines use a reciprocating needle bar carrying a plurality of aligned needles of a predetermined gauge, the needles being constructed and arranged to reciprocably penetrate a backing material passing beneath the needle bar and over a bedrail. As the needles penetrate the backing materials they each carry a separate yarn which yarn is caught either by a looper to create a looped pile article, or by a hook moving, in timed relationship with a knife to create a loop of tufted material which is then cut to create a cut pile article. It is by these well known processes, that loop pile and cut pile carpeting is made.

In order to create patterned tufted articles, the amount of yarn fed to certain needles of the tufting machine is varied so that either high or low piles, respectively, are formed in a patterned series defined in the face of the carpet in the desired shape, design, and/or configuration. Although other methods and devices exist for creating patterns in carpet, to create the pattern within a tufted article, by this method it is necessary therefore to control the amount of yarn fed to the individual tufting machine needles in order to produce the desired pattern. This has been accomplished by using a pattern yarn feed drive assembly, also known as a scroll attachment, which is constructed to control the feed rate of the yarns to the needles of the tufting machine.

One example of such a pattern yarn drive assembly is the YARNTRONICS pattern assembly manufactured by Card-Monroe Corp. of Chattanooga, Tenn., disclosed in U.S. Pat. No. 4,688,497 (the "'497 patent"). The '497 patent discloses a tufting machine a yarn feed mechanism having a plurality of yarn feed rollers, known as controls, disposed in spaced series and operably engaged with either one of a high speed or a low speed drive shaft, respectively, each of the drive shafts being driven in synchronization with the rotation of the tufting machine main drive shaft, and thus in synchronization with the reciprocation of the needles through the backing material. As the yarn is fed to the needles of the tufting machine, predetermined yarn feed rollers are rotated at either a relatively high rate of speed or a relatively low rate of speed with respect to one another such that a sufficient amount of yarn is supplied to associated needles to form either a full height or "high" pile, or a looped "low" pile. If the yarn is fed more slowly to the needles, a low pile is created by "back-robbing" the yarn, in which the yarn is drawn back toward the backing material on the upstitch portion of the tufting cycle to tuft a low pile. In some instances certain yarns may be drawn back snugly against the backing material so that the yarn is masked by the high piles of the carpet until such time as that particular yarn color is desired in the pattern being created in the face of the tufted article.

As known to those skilled in the art, each separate needle which receives a yarn from a given feed roller, or control, will tend to produce a pile having the same relative height as that of the other needles receiving yarn from the same feed roller. To produce patterns, the needles are provided with yarns in a recurring series of a predetermined number of yarns, known as a repeat. The repeats are duplicated in series across the width of the tufting machine. For example, assuming a tufting machine is provided with 72 control pairs, or controls which may comprise a low speed and a high speed yarn drive roller supported on a frame extending the width of the tufting machine, and the gauge or distance between each needle with respect to the adjacent needles in series is one-quarter of an inch, then one spaced series of 72 needles will extend approximately 18 inches, or approximately 45 cm in width. This spaced series of needles will need to be "repeated", therefore, forming a series of "repeats" 18 inches, or approximately 45 cm, wide across the desired width of the tufted article. Thus, if it is desired to produce a tufted article of approximately 13 & ½ feet, or approximately 4 meters, in width, nine such repeats of 72 needles per repeat are required. Accordingly, each of yarn feed drive rollers would have nine separate tufting yarns passed thereover with each one of those yarns being passed on to the corresponding needles of each repeat, for example the first needle in the repeat. Thereafter, the next control pair of yarn feed drive rollers would have nine yarns passed thereover and to the second needle of each repeat, and so on. The repeat width is determined by multiplying the number of controls by the gauge of the needles. The repeat width is then multiplied by the appropriate number to arrive at the appropriate or desired width of the tufted article to be produced.

As a practical limitation, the number of controls provided as a part of the pattern yarn drive assembly is oftentimes determined by the physical limitations of providing sufficient numbers of controls as a part of the pattern yarn drive assembly. As discussed above, if a fourth guage tufting machine is provided with an 18-inch repeat width, 72 control pairs of yarn feed drive rollers are provided. Although it is desirable to feed each needle with yarn separately of the others, it is difficult to provide a separate control pair for each needle as the total number of needles for nine repeats of 72 needles comprising the width of the tufted article equals 648 needles, which would require 648 control pairs if a control pair were to be provided for each needle and yarn. Accordingly, the necessity of using "repeats" to tuft patterned tufted articles has arisen.

Where a tufting machine constructed to tuft patterned articles is provided with a pattern yarn drive assembly, a means must be provided for passing the yarns from each control to the appropriate needles of the repeats across the width of the tufting machine. This can be accomplished by using a tube bank as disclosed in U.S. Pat. No. 2,862,465 to Card (the '465 patent"). In the '465 patent, a tube bank was created from a plurality of guide tubes, one guide tube being provided for each yarn passing to each respective one of the needles of the tufting machine. Thus, for a machine having 72 control pairs of drive rollers feeding 72 yarns to nine different repeats, the tube bank of the '465 patent would be comprised of 648 yarn tubes extending from a point adjacent the respective controls to a point at or close to the appropriate needle mounted on the needle bar of the tufting machine. By fashioning the tube bank in this manner, the appropriate yarns would be guided to the appropriate needles without allowing the yarns to become tangled which would otherwise necessitate machine shut down in order to re-thread the machine.

One problem that has arisen with the use of tube banks, however, is that typically certain of the tubes will be longer than others for corresponding yarns/needles within a repeat as the repeats extend across the width of the tufting machine. For example, and as illustrated in FIG. 1C, the yarn extending from the first control of a pattern yarn drive assembly to the first needle of each of the nine repeats will have nine different lengths, with the length of the yarn closest to repeats 1, 2, and 3 being less than the length of the yarn extending from the first control to the first needle of repeats 7, 8, and 9, respectively. As a result, given the inherent elasticity of the yarn or yarns being used to create the tufted article, it sometimes occurs that when yarn is being back-robbed or fed more slowly to tuft a "low" pile, there tends to be a delay in the time between the slowing of the yarn respective control to the time that the yarn is actually slowed at the appropriate needle of the tufting machine, such that two or three stitches may pass before the yarn is withdrawn, or back-robbed, toward the backing material to create the a low or buried tuft. The reverse effect can also happen such that when the yarn feed rate is increased, for example when changing from a low pile to a high pile, it may take two or three stitches before the yarn is at its full pile height. In both instances, this can result in a lack of pattern definition in the face of the carpet, particularly along the lines adjoining adjacent repeats across the width of the tufted article. This effect is typically more pronounced at the outer margins of the tufted article, and is known generally as pattern fade or tube bank streaks. This effect is illustrated schematically in FIG. 1E, which illustrates the pattern yarn drive assembly of FIG. 1C in which the yarns are fed to nine repeats spaced across the width of the machine, and in which the relative pile height is illustrated, not to scale, below the respective repeats to illustrate how problems in pattern definition or "chop" can occur between repeats across the width of the carpet.

In the effort to combat this loss of pattern definition in the face of the tufted articles include the use of scrambled tube banks with a pair of opposed and counter-rotating puller rolls. A scrambled tube bank is illustrated schematically in FIG. 2A, in which the control pairs, i.e. the high speed and low speed drive rollers, respectively, of the pattern yarn drive assembly are positioned out of a strict ascending or numbered order, as shown in FIG. 1A, for example, across the width of the pattern yarn drive assembly for the purpose of trying to "blend" or more uniformly guide the yarns being used in each of the repeats, nine such repeats in FIGS. 1C and 1E for example, such that a more uniform or blended appearance occurs, which is illustrated schematically in FIG. 2C. However, this may still result in some pattern definition loss in the face of the carpet, which is generally shifted more toward the center of each repeat and away from the adjoining lines of each repeat such that a distinct pattern fade or chop at the adjoining side edges of each repeat is minimized to provide a more uniform finished look across the face of the tufted article. As with the tube bank of the '465 patent to Card, the use of scrambled tube banks has become commonplace in the tufting industry.

However, even with the use of scrambled tube banks the problem persists that a single control is provided for a yarn, or the yarns being fed to respective needles of each repeat across the width of the tufting machine, such that some of the needles within the repeat patterns will ultimately be subject to the problems of yarn elasticity and yarn feed lag during the tufting of the article, with resulting pattern definition loss in the face of the tufted article. What is needed, therefore, is an improved tufting machine pattern yarn feed and distribution device constructed for the purpose of minimizing the lengths of the yarns from the respective control pairs to the needles of the repeats of the tufting machine such that the problems of yarn elasticity and feed lag are minimized. Moreover, there is a need for such an improved tufting machine pattern yarn feed and distribution device which may use existing components to the greatest extent possible in order to minimize manufacturing and operating costs of the device.

SUMMARY OF THE INVENTION

The present invention provides an improved tufting machine pattern yarn feed and distribution device which overcomes a number of the deficiencies of other tufting machine pattern yarn feed and distribution systems. The improved tufting machine pattern yarn feed and distribution device of this invention provides a highly flexible, and precise device for feeding and guiding the yarns from the respective control pairs of a pattern yarn feed drive assembly to the respective needles within each repeat extending across the width of the tufting machine, and which minimizes the length of the yarns extending therebetween for minimizing the problems of yarn elasticity and lag when yarn feed rates are being increased or decreased while tufting a pattern within the face of a tufted article. The improved tufting machine pattern yarn feed and distribution device of this invention, therefore, allows for greater control of yarn feed.

These improvements are provided in an improved pattern yarn feed and distribution device which allows for tufting machine speeds to be maintained at current production rates, and will allow for still greater production rates to be attained using otherwise conventional tufting machines and tufting machine drive systems. The improved tufting machine yarn feed and distribution device of this invention can be matched to the production needs of patterned tufted article manufacturers, while allowing for more precise control over the manufacture of patterned looped pile and cut pile tufted articles. This invention thus provides a simple yet highly efficient pattern yarn feed and distribution device which is well suited for use in the production of a number of tufted article types and configurations.

In a first embodiment of the invention, therefore, a pattern yarn feed drive assembly is provided which has an increased number of controls compared to that number ordinarily used to feed yarn to the needles of a tufting machine, and a first embodiment of an improved tube bank such that the longest length of the yarns passed from any control to a needle within one of the needle repeats is reduced. This embodiment of the invention uses a pair of scrambled tube banks to accomplish the distribution of the yarns from respective controls to the associated needles for each of the needle repeats across the width of the tufting machine and the tufted article, respectively. By providing a greater number of controls, each control generally handles a lesser number of yarns than as before, which, in conjunction with the use of a pair of scrambled tube banks reduces the lengths of the yarns passed on to the needles.

In a second embodiment of the invention, the controls, i.e. the respective high and low speed drive rollers, of the pattern feed yarn drive assembly are divided into for example three, or four, separate sections, each section being allocated to a certain number of repeats across the width of the tufting machine. These roller sections are used with a tube having, for example, three separate tube bank sections to further reduce the lengths of the yarns fed to the needles within the needle repeats.

Accordingly, the objects of the present invention include the provision of an improved tufting machine pattern yarn feed drive and tube bank which provide a simple yet durable and rugged pattern yarn feed and distribution system. The present invention accomplishes this object, among others, while providing for a flexible, efficient, and improved system of feeding yarn from a pattern yarn feed drive assembly to the needles of a tufting machine.

DETAILED DESCRIPTION OF THE PREFERRED EMBODIMENTS

Figure 1A:
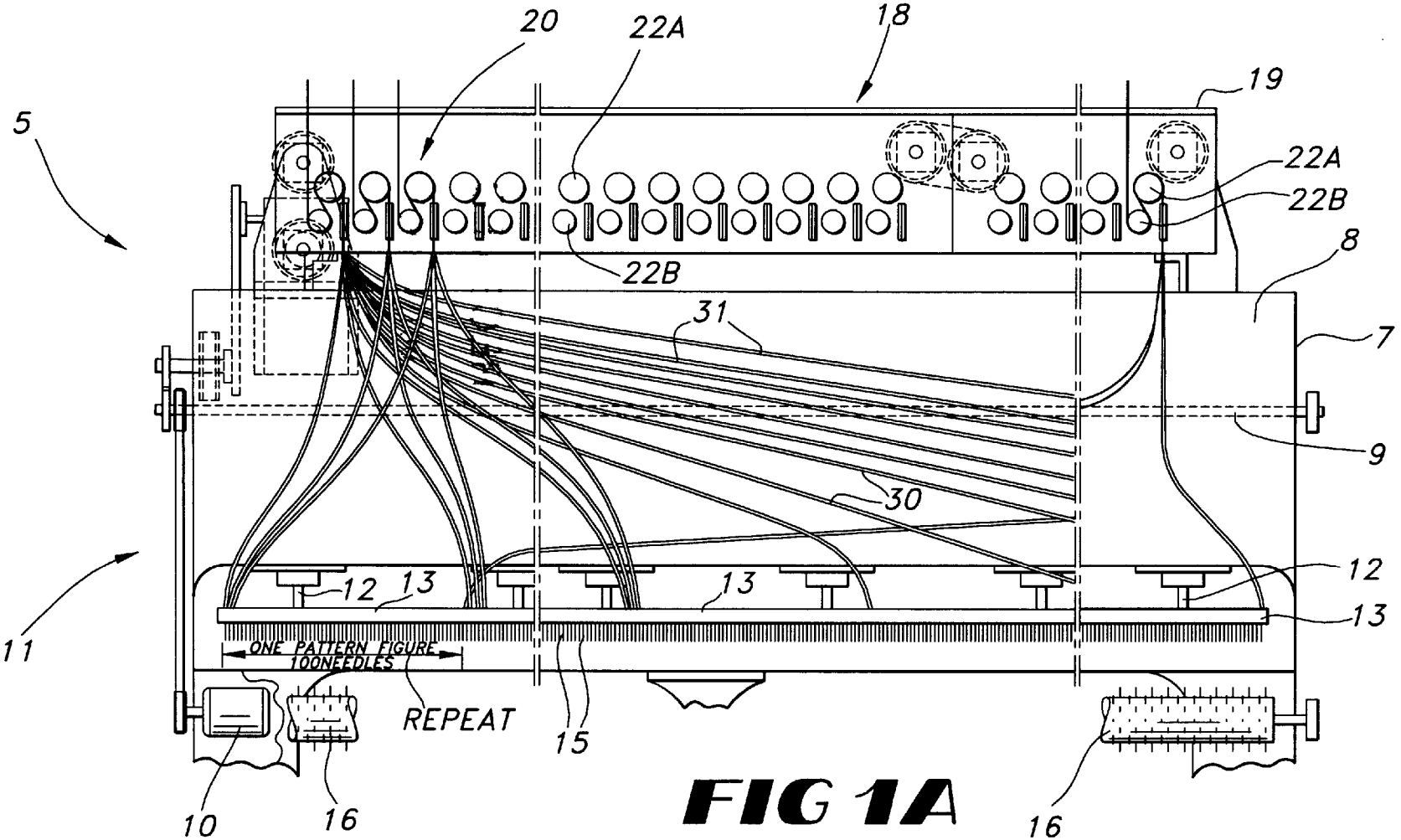
FIG 1A (PRIOR ART)
FIG. 1A is a schematic view of a prior art of tufting machine and a known type of tube bank.

Referring now to the drawings, in which like reference characters indicate like parts throughout the several views, numeral 5 of FIG. 1A refers to a tufting machine of a type known to those skilled in the art. The tufting machine 5 has a frame 7 having a base and a head 8. The head supports an elongate tufting machine drive shaft 9 suitably journaled for rotation along a separate longitudinal axis (not illustrated). Drive shaft 9 is rotated by a drive motor 10, the drive motor being formed as a part of a drive assembly 11 used to rotate the drive shaft in known fashion. Drive motor 10 may comprise an AC/DC motor, or may comprise a servomotor and a position feedback device, for example an encoder, as desired. Although drive assembly 11 is shown as being a conventional pulley and sheave arrangement, or a sprocket and chain drive arrangement, it is anticipated that drive assembly 11 could be a mechanical gear train, gear reduction, or other geared drive assembly for transmitting the rotational movement of the drive shaft (not illustrated) of motor 10 to tufting machine drive shaft 9.

In known fashion, tufting machine drive shaft 9 is constructed to reciprocate a spaced series of push rods 12 extending along the length of an elongate needle bar 13. The needle bar is provided with a spaced and aligned series of needles 15 along its length, in known fashion. The number of needles, as well as the gauge thereof, is dependent upon the tufted articles being produced. Drive shaft 9 and drive motor 10 will reciprocate needle bar 13 toward and away from a backing material (not illustrated) being passed through the tufting machine by a pair of backing material feed rollers 16 beneath the needle bar through a tufting zone.

Tufting machine 5 of FIG. 1A also includes a pattern yarn feed drive assembly 18, supported on a frame 19, of a type disclosed in U.S. Pat. No. 2,862,465 to Card issued Dec. 2, 1958, although any known type of pattern yarn drive assembly, or scroll attachment, could be used in lieu of pattern yarn drive 18. A common feature of all such pattern yarn drive assemblies, however, is that it includes a predetermined number of yarn drive controls 20 comprised of yarn drive rollers 22A, 22B, respectively, disposed in series across the width of the tufting machine. In known fashion, one of rollers 22A, 22B will be a high speed roller, whereas the other roller will be a low speed roller relative to the rotational speed of the high speed roller, each of the rollers being operably engaged with a high speed (not illustrated) or low speed (not illustrated) drive shaft rotated in synchronization with drive shaft 9 and thus the reciprocation of needle bar 13 toward and away from the tufting zone of the machine.

Tufting machine 5 of FIG. 1A also includes a tube bank 30, comprised of a spaced series of elongate and hollow yarn tubes 31, each tube being constructed and arranged to receive a single tufting yarn which is passed therethrough for the purpose of guiding the yarns from the appropriate control pairs 20 to one of the needles 15 spaced along the length of the needle bar. In known fashion, needles 15 may be formed into a spaced series of "repeats", FIG. 1A illustrating a repeat of 100 needles, although this number of needles is described for illustrative purposes only. As shown in FIG. 1A, therefore, if it is assumed that there are ten repeats along the length of needle bar 13 of tufting machine 5, each control pair will thus have ten separate yarns passed thereover for use in forming a patterned tufted article (not illustrated) on tufting machine 5. Accordingly, assuming there are 1,000 needles in the ten repeats of tufting machine 5, there will be 1,000 elongate tubes 31 formed as a part of tube bank 30. It will be appreciated by those skilled in the art that tube bank 30, and tubes 31 are partially illustrated in FIG. 1A for the sake of clarity and that in practice the tube bank would be comprised of the appropriate number of tubes, in this case 1,000 tubes, bent in a smooth curve to comprise the tube bank supported on the frame of the tufting machine in a position intermediate pattern yarn feed drive assembly 18 and needle bar 13.

Figure 1B:
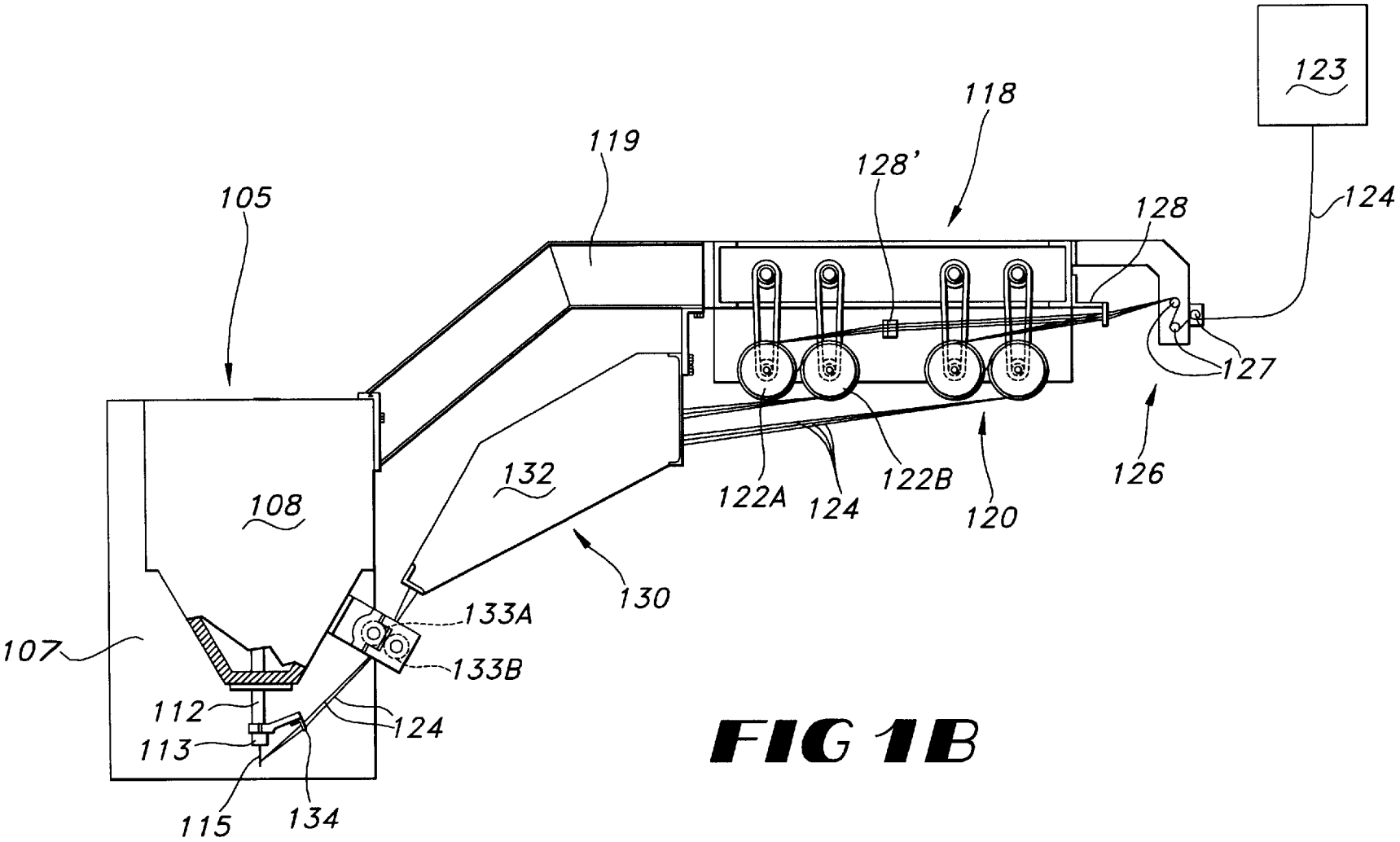
FIG. 1B is a side elevation, in partial cross-section, of a known tufting machine pattern yarn feed drive assembly and tube bank.

Referring to FIG. 1B, tufting machine 105 includes a frame 107 and a head 108 within which a main drive shaft (not illustrated) is supported for driving the push rods which reciprocate needle bar 113 toward and away from the tufting zone of the tufting machine. A spaced series of needles 115 are aligned along the length of needle bar 113, and formed into the appropriate number of repeats based upon the number of controls 120 used in conjunction with the predetermined gauge of needles 115 along the length of the needle bar, which results in either the desired, or required, number of repeats thereon.

Still referring to FIG. 1B, tufting machine 105 includes a pattern yarn feed drive 118 of a type disclosed in U.S. Pat. No. 4,688,497 to Card, et al. Pattern yarn feed drive assembly 118 is supported by a frame 119 on frame 107 of the tufting machine 105, as described in the aforementioned patent. Pattern yarn feed drive assembly 118 includes a plurality of yarn drive controls 120, each control 120 being comprised of at least a first roller 122A and at least a second roller 122B, respectively. It is anticipated, if so desired, that additional yarn feed rollers, or clutches operably geared to the control may be provided for providing a range of yarn drive roller speeds, as described more fully in U.S. Pat. No. 3,084,645 to Card.

Tufting machine 105 is provided with a yarn supply 123, illustrated schematically in FIG. 1B, for example a creel, from which the appropriate number of yarns 124 extend to a yarn tensioning device 126 of a type known in the art, comprised of a spaced series of yarn tensioning bars 127. The yarn is passed through a first yarn guide 128, and looped over the appropriate yarn drive rollers 122A, 122B of the controls 120 before being passed into the individual yarn tubes of tube bank 130 of FIG. 2A. As illustrated in FIG. 1B, certain of the yarns 124 are passed through the first yarn guide 128 and then through a second yarn guide 128' before being passed about the appropriate controls 120, and from there into tube bank 130. After being received in the appropriate yarn tube 131, illustrated schematically in FIG. 2A, formed as a part of tube bank 130, the respective yarns are passed from the tube bank through a pair of opposed and counter-rotating puller rollers 133A, 133B, which are rotated synchronously with the rotation of the tufting machine drive shaft for pulling yarns 124 through tube bank 130 and passing the yarns toward needles 115. After passing through puller rollers 133A, 133B, each yarn 124 is passed through a yarn jerker 134 mounted on needle bar 113, in known fashion.

Figure 1C:
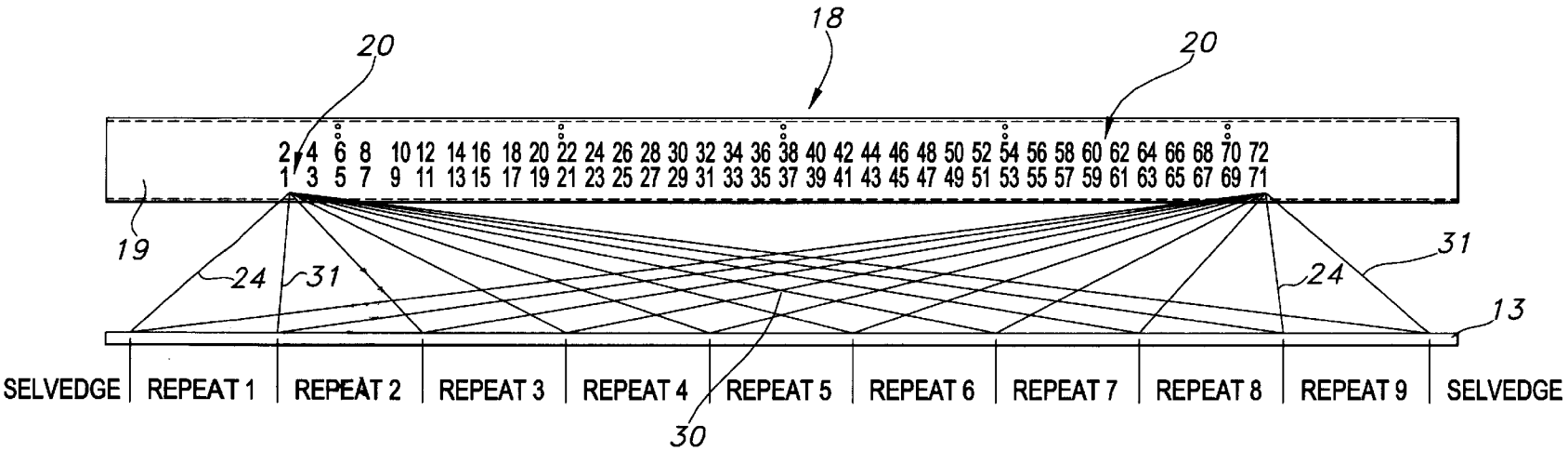
FIG 1C (PRIOR ART)
FIG. 1C is a schematic illustration of the tube bank of FIG. 1A.

The tube bank 30 schematically illustrated in FIGS. 1A and 1C, as well as the scrambled tube bank illustrated in FIGS. 2A, 3A, 4A, and 5A, may each be the tube bank 130 illustrated in FIG. 1B, which is housed within a tube bank housing 132 illustrated in FIG. 1B. It is anticipated, however, that the tube bank housed within tube bank housing 132 would preferably be one of the new embodiments of the tube bank disclosed herein, namely the tube banks schematically illustrated in FIGS. 3A, 4A, and 5A, respectively.

Referring now to FIG. 1C, the tube bank 30 of tufting machine 5 of FIG. 1A is schematically illustrated, in conjunction with a pattern yarn feed drive assembly 18 supported by a frame 19, such as that pattern yarn feed assembly disclosed in U.S. Pat. No. 4,688,497 to Card, et al., referenced above. So constructed, the pattern yarn feed drive assembly 18 includes seventy-two control pairs 20, each control pair comprising at least a pair of yarn drive rollers 22A, 22B (FIG. 1A), one of which is a high speed roller and one of which is a low speed roller, and about which nine yarns are selectively in this instance one yarn for each of the nine repeats shown extending across the width of the tufting machine. Tube bank 30 of FIGS. 1A and 1C is a "straight" tube bank in that it is not scrambled, by reference to the ordering of the controls 20 of drive assembly 18, as is tube bank 130 of FIG. 2A. As seen in FIG. 1C, therefore, the nine yarns 24 looped about the first control positioned at the location designated as control number 1 on pattern yarn feed drive 18 are passed to the first needle in each one of the nine repeats, respectively. This type of construction would be common, for example, in a tufting machine having seventy-two needles at a quarter-inch gauge spacing for an eighteen-inch repeat width, although the gauge of the needles, and thus the repeat width along the width of the needle bar may be varied as desired and in accordance with the production requirements of the tufted articles being produced. As thus seen, each respective one of yarns 24 has a different length with respect to each other one of the yarns 24 extending from the first control, with the yarn 24 extending from the first control to the first needle of Repeat 2 being the shortest length of yarn, and the yarn 24 extending from the first control to the first needle of Repeat 9, and to the first needle tufting the selvedge adjacent Repeat 9, having the longest length.

Assuming therefore that yarn 24 from the first control is to be fed at a reduced rate of speed relative to a high rate of speed, i.e. it is being back-robbed, yarn 24 will be made taut more quickly, and thus back-robbed, for Repeats 1, 2, 3, and 4, than it would be for Repeats 5 through 9, as the yarn 24 possesses a degree of elasticity, dependent on the material of which the yarn is made, which, in conjunction with the change of speed effected by driving yarn 24 with the low speed yarn drive roller 22B rather than the high speed yarn drive roller 22A for tufting a low pile loop of yarn in the backing material, may result in a loss of pattern definition, i.e. fading, of the pile heights. This is illustrated schematically in FIG. 1E, in which a discernible line in the pile schematically shown in the face of the carpet where the repeats adjoin one another along the length of the needle bar, and thus across the width of the tufted article.

Figure 1D:
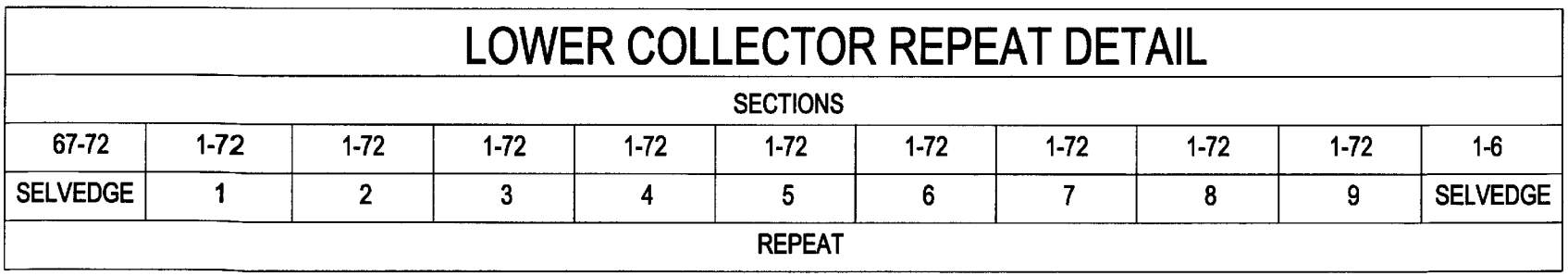
FIG 1D (PRIOR ART)
FIG. 1D is a schematic illustration of the yarn ends fed and distributed to the tufting needles within each repeat of needles across the width of a tufting machine with the tube bank of FIG. 1C.
Figure 1E:
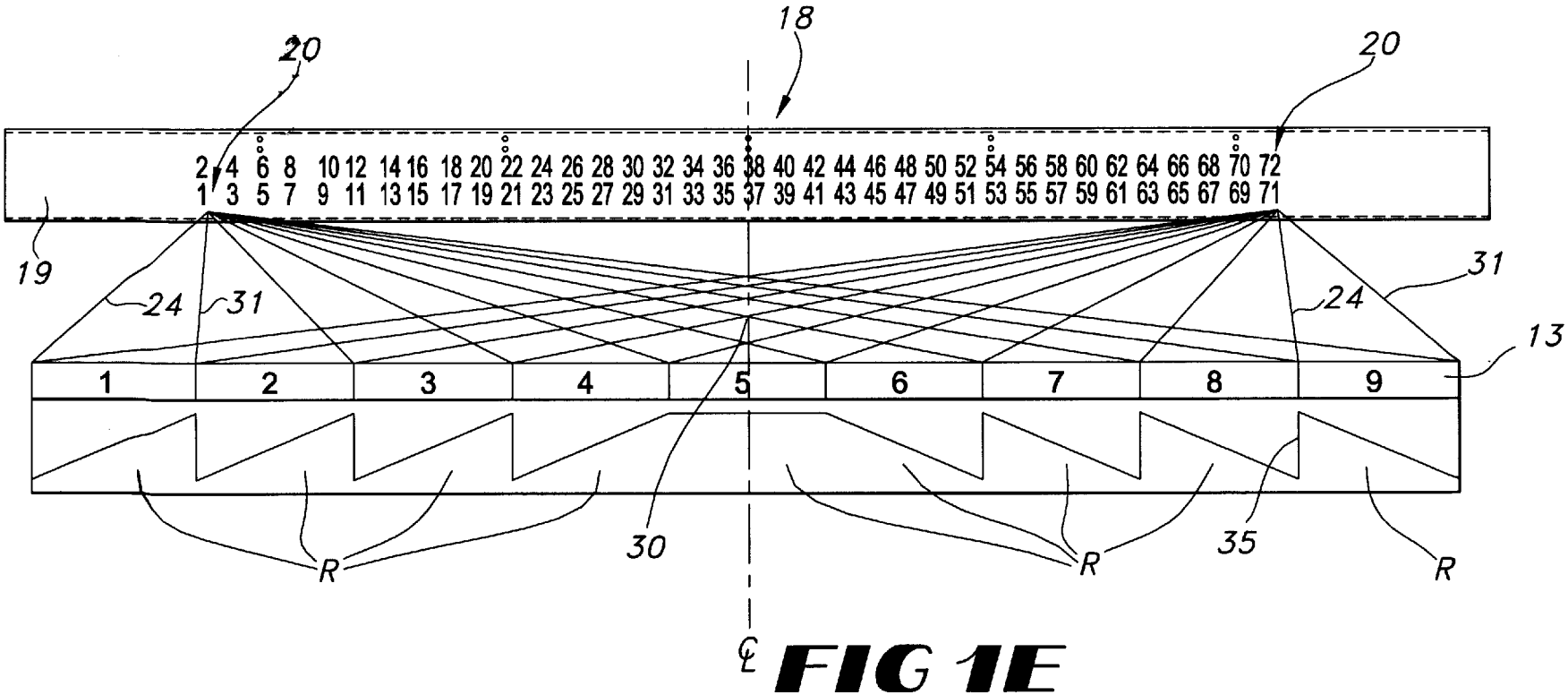
FIG 1E (PRIOR ART)
FIG. 1E is a schematic illustration of the loss in pattern definition across the width of a tufted article resulting from the use of the tube bank of FIGS. 1A and 1C.

FIG. 1D schematically illustrates the lower collector repeat detail of the tube bank and pattern yarn feed drive assembly of FIG. 1C, in which it is shown that each one of the nine repeats is provided with yarns one through seventy-two from the seventy-two controls 20 provided as a part of the pattern yarn feed drive assembly 18 of FIG. 1C. It is this type of arrangement which is disclosed in U.S. Pat. No. 2,862,465 to J. L. Card.

Figure 2A:
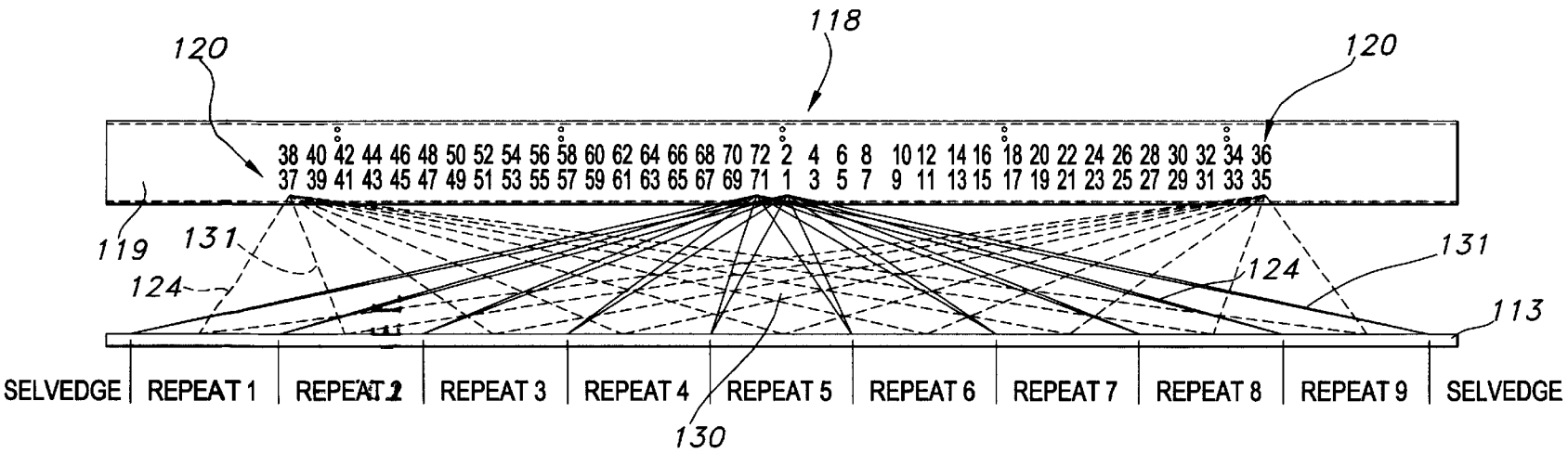
FIG 2A (PRIOR ART)
FIG. 2A is a schematic illustration of a known tube bank.

FIG. 2A illustrates a known type of a "scrambled" tube bank also used with a tufting machine having a pattern yarn feed drive assembly, such as yarn feed drive assembly 118 supported by a frame 119, and which may comprise by way of example, and not limitation, that pattern yarn feed mechanism for tufting machines disclosed in U.S. Pat. No. 4,688,497 to Card, et al. Selected yarns 124 are passed about selected yarn controls 120 of the yarn feed drive assembly 118, and passed on to needle bar 113, and to the needles (not illustrated) mounted thereon. In FIG. 2A, however, and unlike the tube bank in FIGS. 1A and 1C, the respective yarn tubes 131 of tube bank 130 are not "straight", i.e. they and the controls are not positioned in an ascending numerical order. In this configuration, the yarn tubes are scrambled or mixed as are the locations of controls one through seventy-two to minimize the differences in yarn length, and thus pile height, or chop, present between the repeats where they adjoin one another across the width of the tufted article. This has a tendency to diminish the loss in pattern definition which occurs where one repeat adjoins an adjacent repeat, and tends to move any fading in the pattern that may occur more toward the center of the repeat where it is hopefully less noticeable than where the repeats abut one another across the width of the tufted article. It is understood that each one of yarn tubes 131 shown schematically in FIG. 2A comprises a hollow rigid tube formed of a suitable metallic or plastic material, for example aluminum, that may be bent in a smooth curve and formed to fit within a tube bank housing 132, as illustrated in FIG. 1B, for passing yarns from the respective controls 20 numbered one through seventy-two to the puller rollers 133A, 133B, respectively, of the tufting machine.

Figure 2B:
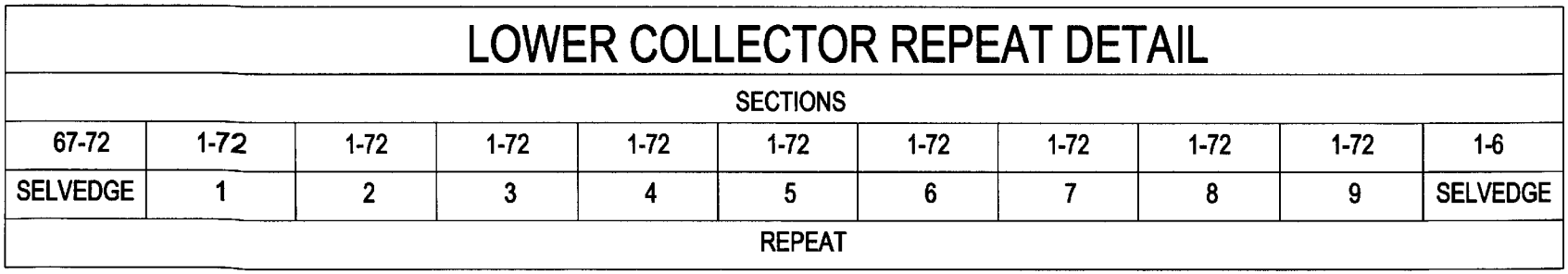
FIG 2B (PRIOR ART)
FIG. 2B is a schematic illustration of the yarn ends fed and distributed to the tufting needles within each repeat of needles across the width of a tufting machine with the tube bank of FIG. 2A.

As shown in FIG. 2B, although the tube bank is scrambled, as there are only seventy-two controls 20, each one of the nine repeats is provided with yarns one through seventy-two for needles one through seventy-two, of each repeat, respectively, by these seventy-two controls. Thus, and although the scrambled tube bank 130 represented an advance in the art, the problem remains of there being discrepancies in yarn lengths extending from a shared control to the common needles fed thereby and spaced from one another in the several repeats across the width of the tufted article. Therefore, the problem of pattern definition or fade due to yarn elasticity and the lag in yarn speed control caused in taking the elasticity out, or putting the elasticity back in, certain to make them taut or slack, respectively, as they are fed to tuft low and high piles, for example, still persists.

Figure 3A:
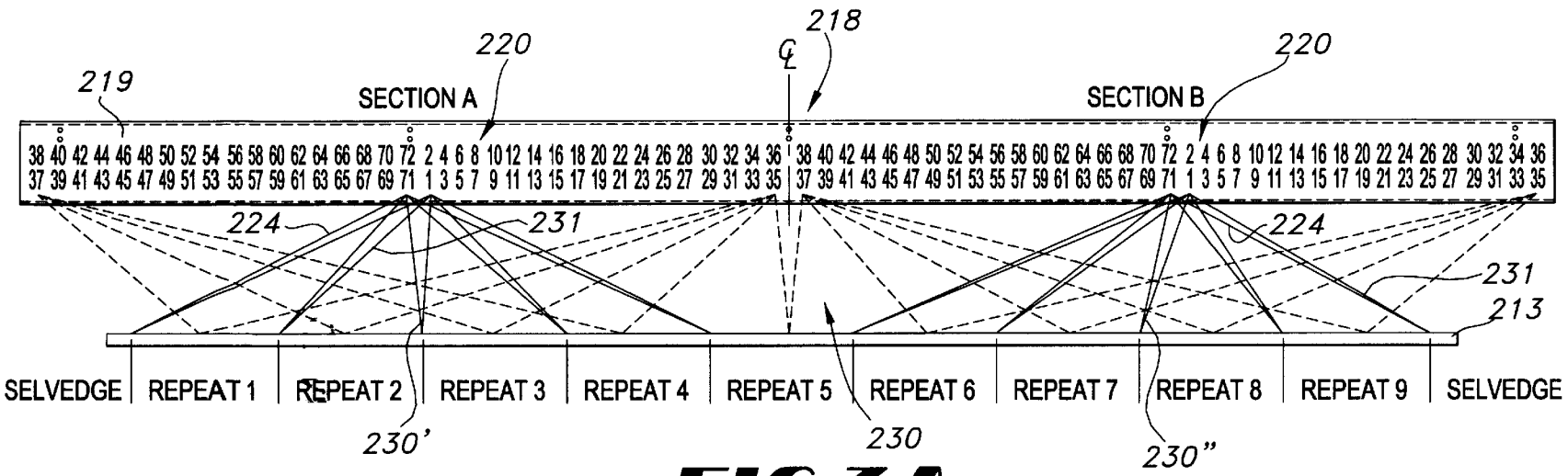
FIG. 3A is a schematic illustration of a first embodiment of the improved tufting machine pattern yarn feed and distribution device of this invention.
Figure 3B:
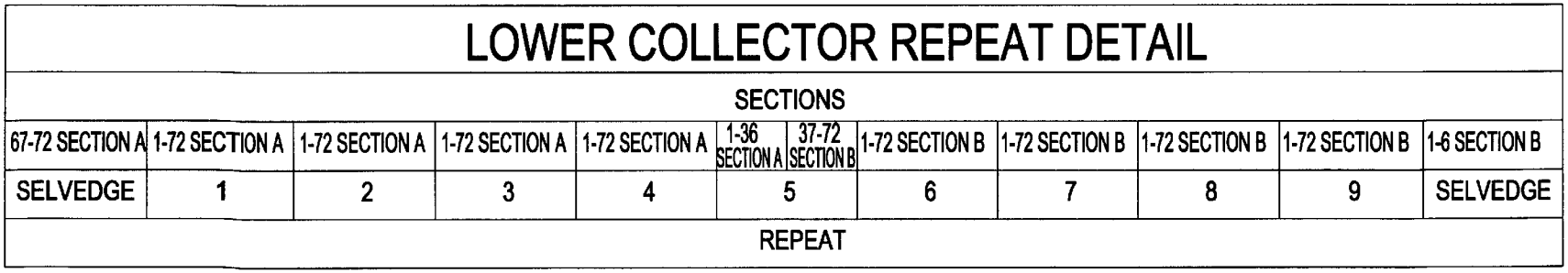
FIG. 3B is a schematic illustration of the yarn ends fed and distributed to the tufting needles within each repeat of needles across the width of a tufting machine with the tube bank of FIG. 3A.

A first embodiment of the improved tufting machine pattern yarn feed and distribution device of this invention is illustrated in FIGS. 3A and 3B. In FIG. 3A, a tufting machine, for example either of tufting machines 5 or 105 of FIGS. 1A and 1B, respectively, will be provided with a pattern yarn feed drive assembly 218 supported on a frame 219 The pattern yarn feed drive assembly has a first control section designated as Section A, and a second control section designated as Section B, such that each control section includes seventy-two yarn drive control pairs, or simply "controls," 220, thus doubling the number of controls for the same number of repeats. By doing so each control generally handles a lesser number of yarns, approximately half as much, than before so that the length of the yarns passing from the respective controls to the respective needles (not illustrated) is reduced in order to minimize the known problems of yarn elasticity and yarn lag.

The tube bank 230 of the tufting machine pattern yarn feed and distribution device of FIG. 3A includes a pair of scrambled tube bank sections 230', 230", again, based on the ordering of the controls, positioned on either side of center line "C" of the tufting machine, such that the lower collector repeat detail illustrated schematically in FIG. 3B discloses that Repeats 1 through 4 are fed with tufting yarns 224 from control Section A, that Repeats 6 through 9 are fed with tufting yarns 224 from control Section B, and Repeat 5 is provided with thirty-six yarns from each one of the two yarn control Sections, respectively. Tube bank sections 230', 230", which are schematically illustrated in FIG. 3A, will selectively, based on about which one of the drive rollers the yarn is passed, direct the yarns 224 passed about the selected ones of controls 1, 2, 3, 4, through 69, 70, 71, and 72, respectively, of each control section, through the yarn tubes 231 thereof, and guide the yarns separately to a position with respect to its tufting needle (not illustrated) adjacent one another in the adjacent repeats extending along needle bar 213. The shorter yarn lengths resulting from this construction minimize any tendency of pattern definition loss to occur from repeat to repeat across the width of the tufted article.

By doubling the number of yarn drive controls 220, the number of yarns 224 carried on each control is reduced, and thus the lengths of the respective yarns 224 fed by each control, and each control section, is shortened so that a more uniform appearance with less pattern chop in the face of the tufted article occurs during tufting operations. Moreover, the embodiment of the improved tufting machine yarn feed and distribution device illustrated in FIG. 3A can be constructed of readily available tufting machine components, and can take full advantage of the improved capabilities of machine shops and fabrication facilities for creating not one set of yarn drive controls 220, but two sets of yarn drive controls 220 that will fit within the same space of the earlier single set of controls of the earlier pattern yarn feed drive assemblies. The pattern yarn feed drive assembly of U.S. Pat. No. 4,688,497 to Card, et al., for example, is particularly well suited to this task, which due to its construction allows for easily passing selected tufting yarns about selected ones of the yarn feed drive rollers 122A, 122B (FIG. 1B) of the respective yarn drive controls 220, in close confinement, without the need to otherwise disassemble all or a portion of the tufting machine, or cut the yarns in order to complete the threading of the yarns about the appropriate controls and to then thread the needles of the tufting machine.

Figures 4A, 4B:
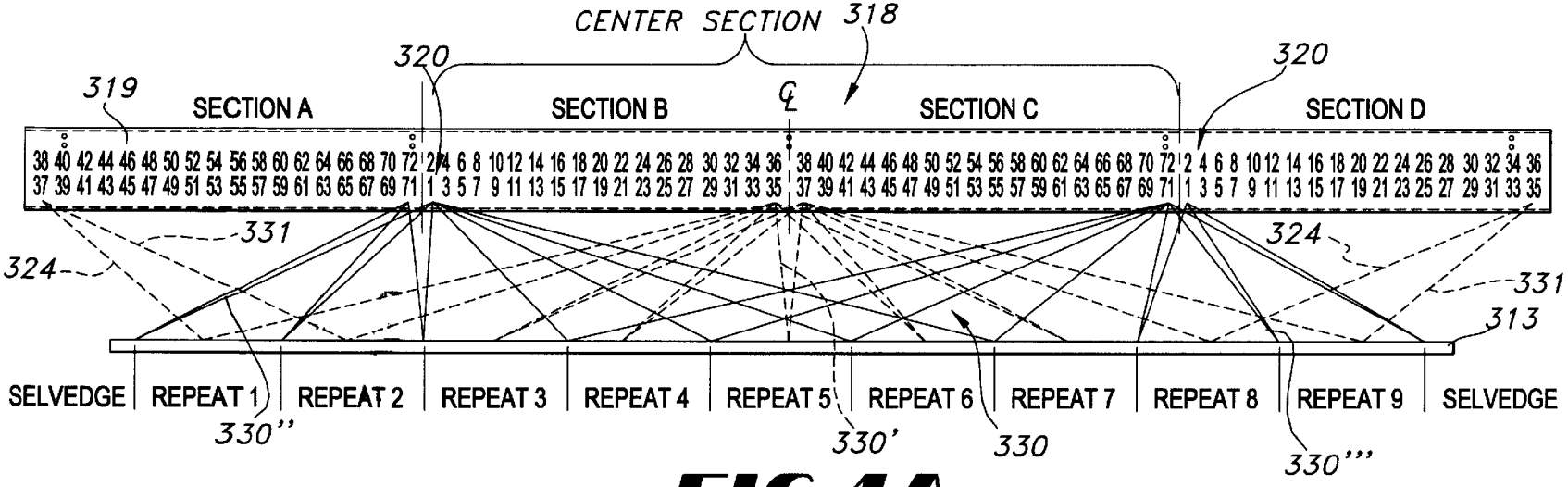
FIG. 4A is a schematic illustration of a second embodiment of the improved tufting machine pattern yarn feed and distribution device of this invention.
FIG. 4B is a schematic illustration of the yarn ends fed and distributed to the tufting needles within each repeat of needles across the width of a tufting machine with the tube bank of FIG. 4A.

A second embodiment of the improved tufting machine pattern yarn feed and distribution device of this invention is schematically illustrated in FIGS. 4A and 4B. The yarn feed and distribution device of FIG. 4A is a pattern yarn feed drive assembly 318 supported by a frame 319 on the head (not illustrated) of an otherwise conventional tufting machine (not illustrated), such as tufting machines 5, 105 of FIGS. 1A and 1B, respectively, for example. The pattern yarn feed assembly in this embodiment has two primary sections of seventy-two yarn drive controls 320, comprised of Sections A and B, and C and D. However, each of these two primary control sections is further broken out into a central section comprised of control Sections B and C, which, upon reference to FIGS. 1C and 2A is shown to have the standard pattern of seventy-two yarn drive feed roller pairs, 320 also known to those in the art as controls, arranged from control one through control seventy-two, with two additional halves of a standard control set, namely control Section A having controls thirty-seven through seventy-two, and control Section D having controls one through thirty-six. So constructed, therefore, the center section is provided with a complete set of seventy-two controls 320, and the two side sections, Sections A and D, respectively, are provided with thirty-six controls 320 each.

Although not specifically illustrated herein, it is anticipated that Sections A and D need not have 36 controls for example, but each will have a fractional number of the total number of controls contained in the center section of the controls, comprised of Sections B and C, as shown in FIG. 4A. For example, therefore, although there may be seventy-two controls in the center section, Sections A and D may have only 18 controls, or may have 48, but each will have some number of controls that will be a fraction of the number of controls contained in the center section. This, in combination with the new construction of the tube bank 330 illustrated in FIG. 4A provides even shorter lengths between the yarns passed about the selected ones of the controls 320, and passed through their appropriate yarn tubes 331 to the needles (not illustrated) extending along the length of needle bar 313.

Also, and if so desired, the two primary sections of controls of FIG. 4A can be further broken out into four separate control sections, namely Section A through Section D, each having thirty-six controls 320, and extending across the width of the tufting machine such that a first control Section A, a second control Section B, a third control Section C, and a fourth control Section D extend across the width of pattern yarn feed drive assembly 318. Each one of the four yarn drive control sections includes thirty-six separate controls 320, each control having at least a pair of yarn drive rollers (not illustrated), a high speed and a low speed drive roller, respectively, constructed in known fashion. Again, and as with the embodiment of FIGS. 3A and 3B, the pattern yarn drive assembly 318 of FIG. 4A could be constructed of that device disclosed in U.S. Pat. No. 4,688,497 to Card, et al.

Unlike the two tube bank sections 230', 230"comprising tube bank 230 of FIG. 3A, tube bank 330 of FIG. 4A is constructed in a different configuration, as illustrated schematically in FIG. 4B, such that an even more uniform distribution of the yarns across the width of the tufted article is provided. This configuration assists in minimizing the length of the longest yarn 324 extending from any one of the controls to its tufting needle, and thus minimizes the problems of yarn elasticity and yarn feed lag, so that an even more uniform pattern definition is attained in the face of the tufted article.

Tube bank 330 of FIG. 4A has three tube bank sections which correspond roughly to the center and the two side sections of the pattern yarn drive assembly 318 of FIG. 4A. So constructed, tube bank 330 will have a first center tube bank section 330' positioned with respect to control Sections B and C, a second side tube bank section 330" extending along one end of the center tube bank section with respect to control Section A, and a spaced third side tube bank section 330'" extending along the other end of the center section tube bank 330' with respect to control Section D. When combined, however, these three tube bank sections together form a single tube bank 330. When tube bank 330 is completely constructed, only a portion of the tube bank being shown schematically in FIGS. 4A and 4B, the yarn tubes 331 of the three tube bank sections 330', 330", and 330'", will be interwoven among one another to the extent shown in the lower collector repeat detail of FIG. 4B. So constructed, the center tube bank section 330' will guide selected tufting yarns 324 of control Sections B and C, the "center" section of controls, to Repeats 3 through 7. The second tube bank section 330" will feed the tufting yarns of control Section A, and selected ones of the yarns of control Section B to the needles of Repeats 1 and 2. Similarly, the third tube bank section 330'" will feed the tufting yarns from control Section D, and selected ones of the yarns of control Section C to all of the needles of Repeats 8.

As also shown in FIG. 4B, a selvedge, which extends along the two outside edges of the tufted article and along its length, is also supplied with tufting yarns by pattern yarn feed drive assembly 318 and tube bank 330. The selvedge adjacent Repeat 1 is fed with tufting yarns from yarn drive controls 320 numbered sixty-seven through seventy-two of control Section A through tube bank section 330", whereas the third tube bank section 330'" will feed tufting yarns from the yarn drive controls numbered one through six of control Section D to the selvedge adjacent Repeat 9. The selvedge, as known to those in the art, is formed when a shifting needle bar is used such that an overshift margin is created along the side edges of the tufted article so that an abrupt end or chop will not exist where the carpet is trimmed from the excess backing material extending along its side edges after being tufted. So constructed, tube bank 330 thus shortens the longest of any one of tufting yarns 324 so that a much more blended or uniform appearance of the graphic pattern in the face of the tufted article is attained with far lesser likelihood of discernible pattern fade or tube streaking being apparent in the face of the tufted article.

The tube bank 330 shown in FIGS. 4A and 4B comprises a form of scrambled or mixed type of tube bank in which the respective yarn tubes guiding the yarns selectively passed about selected ones of the respective controls of the three control sections, namely Section A, combined Sections B and C, and Section D, extend in an ascending numerical order to the associated needles of the repeats fed thereby. It is anticipated, however, that an additional "blended" type of a scrambled construction could be used to fabricate tube bank sections 330', 330", and 330'" for providing an even greater reduction of the yarn lag/elasticity problem. In this type of construction, the yarn tubes, for example yarn tubes 331 of FIGS. 4A & B, would not extend from the respective controls to the needles of each repeat in a strict numerical order. Instead the ordering of the controls is blended to minimize the lengths of what would have been the longest yarns within the repeat. This is shown schematically in FIGS. 5A and 5B, in which a pattern yarn drive assembly 418 supported on a frame 419 is provided with three control sections comprised once again of Section A, combined Sections B&C together, and Section D, with a tube bank 430 having three separate scrambled tube bank sections 430', 430", and 430'", guiding yarns 424 selectively passed about selected controls 420 and guided toward the tufting needles (not illustrated) mounted on needle bar 413 in an aligned series of repeats through the respective ones of yarn tubes 431.

Figure 5A:
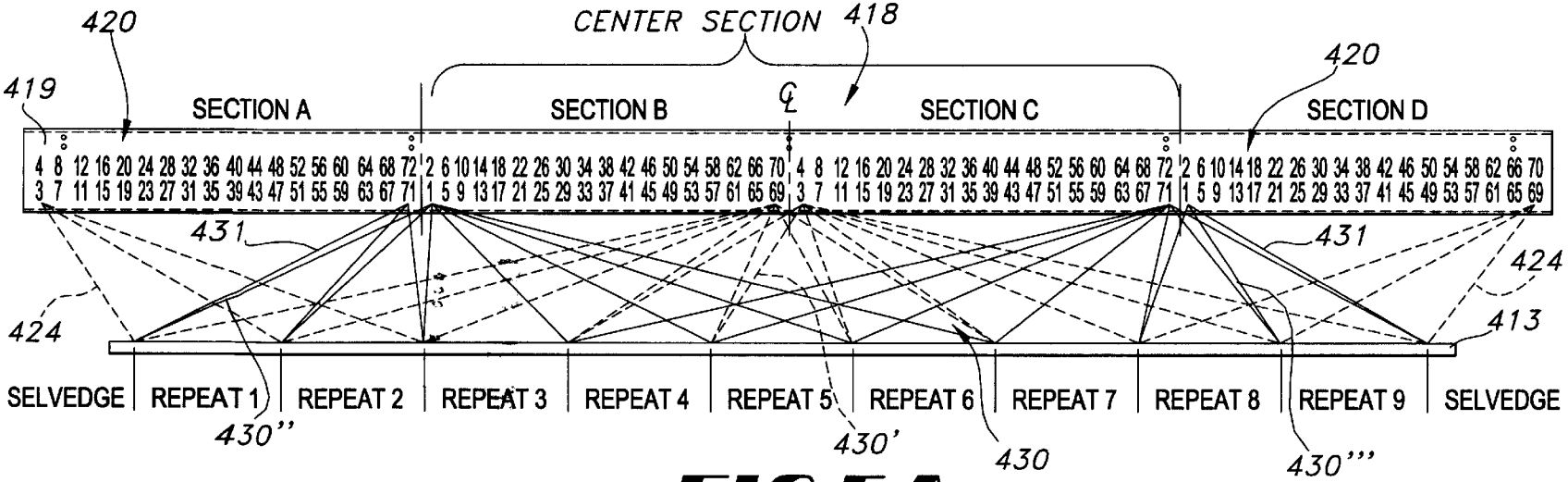
FIG. 5A is a schematic illustration of a fourth embodiment of the improved tufting machine pattern yarn feed and distribution device of this invention.
Figure 5B:
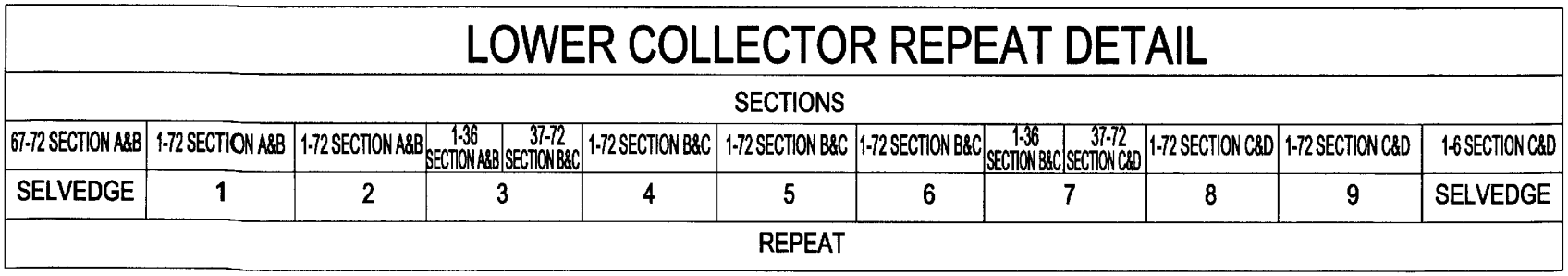
FIG. 5B is a schematic illustration of the yarn ends fed and distributed to the tufting needles within each repeat of needles across the width of a tufting machine with the tube bank of FIG. 5A.

As shown in FIG. 5B, however, the pattern of the yarn "ends" distributed to the repeats through these three tube bank sections differs from that of FIG. 4B for an even more blended tufted article. In this embodiment of the tube bank 430, the first tube bank section 430' guides yarns from control Sections B & C to needles thirty-seven to seventy-two of Repeat 3, all of the needles of Repeats 4 through 6, and needles one through thirty-six of Repeat 7. The second tube bank section 430" feeds yarns from control Section A and control Section B to all of the needles of Repeats 1 and 2, and to needles one through thirty-six of Repeat 3; and the third tube bank section 43'" feeds yarns from control Sections C & D to needles thirty-seven to seventy-two of Repeat 7, and to all of the needles of Repeats 8 and 9. The respective selvedges receive yarns from control Sections A & B, and C & D, from the second and third tube bank sections, respectively. The yarns are thus "blended," to reduce yarn lengths through all of the repeats to minimize, if not eliminate, the problem of pattern fade. The invention disclosed in all of its embodiments herein, therefore, provides for far greater flexibility in addressing the problems of pattern fade, chop, and/or tube streaks in the face of the tufted article than the known types of pattern yarn feed devices and tube banks.

It is also possible, although not illustrated in FIGS. 4A through 5B, that a separate "straight" or "scrambled" tube bank could be provided for each of the, for example, three or four control sections of the embodiments of the yarn feed drive assemblies 318 and 418 illustrated in FIGS. 4A and 5A, namely the four control Sections A–D, separately, or in combination as three control sections as discussed, as is shown for the two control sections A & B for yarn feed drive assembly 218 in FIGS. 3A and 3B. Moreover, the two control Sections A and B of FIG. 3A could be fashioned as a "straight" tube bank, if desired. Although having a separate tube bank, for each control section is still an improvement over the known types of tube banks and pattern yarn feed drive assemblies, the problem may still persist, however, that there may be a pattern fade or tube streak discernible along the abutting edges of the repeats supplied with yarn through these separate tube banks, and thus the construction of the tube banks 330, 430 is preferred which "blends" the yarns across the width of the tufted article. It is expected that any such pattern fade would occur in a four separate tube bank embodiment of the invention where the last outermost repeat fed by control Section A, for example, adjoins the first outermost repeat fed by control Section B, these being the points within these two adjacent repeats fed with the longest yarns from their respective control sections, and thus the yarns most susceptible to yarn elasticity and lag when either back-robbing, or feeding, the yarns to create either low or high tufted piles, respectively.

Although it may be desirable to drive each one of yarns 224, 324, 424 of FIGS. 3A–5B separately across the entire width of the tufting machine, for example, thus having a "repeatless" tufting machine, this is oftentimes not attainable due to cost and space considerations. The improved tufting machine yarn feed and distribution devices of FIGS. 3A, 4A, and 5A thus offer the advantage of being able to be manufactured relatively quickly and easily, and can be easily fit or retrofit to most any type of existing tufting machine used to tuft patterned tufted articles.

While preferred embodiments of the invention have been disclosed in the foregoing Specification and Drawings, it is understood by those skilled in the art that variations and modifications thereof can be made without departing from the spirit and scope of the invention, as described hereinabove. In addition, the corresponding structures, materials, acts, and equivalents of all means or step plus function elements in the claims are intended to include nay structure, material, or act for performing the functions in combination with other claimed elements, as specifically claimed herein.

I claim:

1. A tufting machine with pattern yarn feed and distribution device used to produce a tufted article having a graphic pattern defined in its face, the tufting machine having an elongate frame, the frame including a base and a head supported on the frame above the base, the head and the base of the tufting machine defining a tufting zone therebetween, and a supply of tufting yarn, said tufting machine comprising:

at least one elongate needle bar extending in the lengthwise direction of the tufting machine and supported on the head of the tufting machine for reciprocating movement toward and away from the tufting zone, said at least one needle bar having a predetermined number of tufting needles mounted thereon in aligned series and extending at least partially along the length of said at least one needle bar;

a pattern yarn feed drive assembly supported on the head of the tufting machine with respect to said at least one needle bar, said yarn feed drive assembly having at least two separate yarn drive control sections, each said yarn drive control section having a plurality of yarn drive controls about which selected ones of the yarns are selectively passed, each said yarn drive control being constructed and arranged to selectively feed the selected ones of the tufting yarns to selected ones of said needles to form multiple repeats of recurring predetermined numbers of yarns in series across the tufting machine to form the desired graphic pattern in the tufted article; and a yarn feed tube bank constructed and arranged to guide a respective one of the yarns to each said needle, respectively, said tube bank having a predetermined number of elongate yarn tubes, one each of said yarn tubes being provided for each said needle of the tufting machine;

said tube bank being comprised of at least two separate tube bank sections, each said tube bank section being constructed and arranged to guide yarns to each of the needles of each of the multiple repeats extending across the tufting machine with the lengths of the yarns passed therethrough from the respective ones of said yarn drive controls to said needles of said multiple repeats being minimized, and with at least one of said at least two tube bank sections being provided for each respective one of said at least two yarn drive control sections;

whereby each of the tufting yarns is selectively passed about a selected one of the yarn drive controls and is then passed through a respective one of the yarn tubes for being guided to a respective one of the tufting needles, and is selectively fed to its respective needle by its yarn drive control in accordance with the graphic pattern being tufted in the face of the tufted article.

2. The tufting machine of claim 1, wherein said pattern yarn feed drive assembly comprises two of said yarn drive control sections.

3. The tufting machine of claim 2, wherein said at least two separate tube bank sections comprises two separate tube bank sections, and wherein one of said two tube bank sections is provided for each said yarn drive control section.

4. The tufting machine of claim 1, wherein each of said two tube bank sections guides the yarns to one-half of said predetermined number of needles.

5. A tufting machine having a pattern yarn feed and distribution device used to produce a tufted article having a graphic pattern defined in its face, the tufting machine having an elongate frame defining a tufting zone, and a supply of tufting yarn, said tufting machine comprising:

at least one elongated needle bar extending in the lengthwise direction of the tufting machine and movable toward and away from the tufting zone, said at least one needle bar having a predetermined number of needles mounted at least partially along the length of said at least one needle bar;

a pattern yarn feed drive assembly supported on the frame of the tufting machine and a first center yarn drive control section having a first predetermined number of said yarn drive controls;

a second yarn drive control section positioned at one end of said first yarn drive control section; and a third yarn drive control section positioned at the other one end of said first yarn drive control section and being spaced from said second yarn drive control section;

said second and said third yarn drive control sections each having a second predetermined number of said yarn drive controls which is a fractional number of said first predetermined number of yarn drive controls; each said yarn drive control being constructed and arranged to selectively feed the yarns to selected ones of said needles; and a yarn feed tube bank for guiding respective ones of the yarns to each said needle, respectively, said tube bank having a predetermined number of elongate yarn tubes, one of each of said yarn tubes being provided for each said needle of the tufting machine;

said tube bank being comprised of at least two separate tube bank sections, each said tube bank section being constructed and arranged to minimize the length of the yarns passed therethrough to each said needle, respectively, with at least one of said tube bank sections being provided for one of said yarn drive control sections;

whereby each of the yarns is selectively passed about a selected one of said yarn drive controls and through one of said yarn tubes for being guided to one of said needles, and each yarn is selectively fed to its needle by its selected yarn drive control in accordance with the graphic pattern being tufted in the face of the tufted article.

6. The tufting machine of claim 5, wherein said at least two separate tube bank sections comprises a first center tube bank section, a second tube bank section at one end of said first tube bank section, and a third tube bank section at the other end of said first tube bank section, each of said tube bank sections being separate of the other.

7. The tufting machine of claim 6, wherein said second and said third tube bank sections each comprises an identical number of yarn tubes, and where said first tube bank section has a greater number of yarn tubes than either of said second and said third tube bank sections.

8. The tufting machine of claim 6, wherein said second and said third tube bank sections each guides a respective one of the yarns to one each of a second predetermined number of needles mounted on said at least one needle bar at each of the opposed ends of said predetermined number of needles for tufting one of a pair of opposed selvedges extending the length of the tufted article being produced on the tufting machine.

9. The tufting machine of claim 6, wherein said second and said third tube bank sections each guides a number of yarns less than first tube bank section.

10. A tufting machine with a pattern yarn feed and distribution device used to produce a tufted article having a graphic pattern defined in its face, the tufting machine having a frame including a base and a head, the head and the base of the tufting machine defining a tufting zone therebetween, and a supply of tufting yarn, said tufting machine comprising:

at least one elongated needle bar extending transversely and supported on the head of the tufting machine for reciprocating movement toward and away from the tufting zone, said at least one needle bar having a predetermined number of needles mounted thereon;

a pattern yarn feed drive assembly supported on the head of the tufting machine and having at least two yarn drive control sections, each said yarn drive control section having a plurality of yarn drive controls about which selected ones of the yarns are received, each said yarn drive control being constructed and arranged to selectively feed the yarns to selected ones of said needles; and a yarn feed tube bank for guiding respective ones of the yarns to each said needle, respectively, said tube bank having a predetermined number of elongate yarn tubes, one each of said yarn tubes being provided for each said needle of the tufting machine;

said tube bank being comprised of at least two separate tube bank sections, each said tube bank section being substantially identical to and in reverse hand with respect to one another and constructed and arranged to minimize the lengths of the yarns passed therethrough to each said needle, with one of said two tube bank sections being provided for each respective one of said yarn drive control sections, and wherein said tube bank sections each guide yarns to a second predetermined number of needles mounted on said at least one needle bar at the opposed ends of said predetermined number of needles for tufting one of a pair of opposed selvedges extending the length of the tufted article being produced on the tufting machine, whereby each of the yarns is passed about a selected one of said yarn drive controls and through said yarn tubes so as to be guided to one of said needles, with each yarn selectively fed to its respective needle by its yarn drive control in accordance with the graphic pattern being tufted in the face of the tufted article.

11. A tufting machine with pattern yarn feed and distribution device used to produce a tufted article having a graphic pattern defined in its face, the tufting machine having an elongate frame, including a base and a head defining a tufting zone therebetween, and a supply of yarn, said tufting machine comprising:

at least one elongated needle bar extending transversely across the tufting machine and supported on the head of the tufting machine for reciprocating movement toward and away from the tufting zone, said at least one needle bar having a predetermined number of needles mounted thereon;

a pattern yarn feed drive assembly supported on the head of the tufting machine and having at least two separate yarn drive control sections, each said yarn drive control section having a plurality of yarn drive controls about which selected ones of the yarns are passed, each said yarn drive control being constructed and arranged to selectively feed the yarns to selected ones of said needles; and a yarn feed tube bank constructed and arranged to guide the yarns to said needles, said tube bank having a predetermined number of elongated yarn tubes, one each of said yarn tubes being provided for each said needle of the tufting machine;

said tube bank being comprised of at least two separate tube bank sections, each of said tube bank sections comprising a separate scrambled tube bank and being constructed and arranged to minimize the length of the yarns passed therethrough from the respective ones of said yarn drive controls to each said needle, with one of said tube bank sections being provided for each one of said at least two yarn drive control sections;

whereby each of the yarns is passed about a selected one of said yarn drive controls and through a respective one of said yarn tubes so as to be guided to one of said needles, so that each yarn is selectively fed to its respective needle by its yarn drive control in accordance with the graphic pattern being tufted in the face of the tufted article.

12. A tufting machine having a pattern yarn feed and distribution device for producing a tufted article having a graphic pattern defined in its face, the tufting machine having an frame including a base and a head defining a tufting zone therebetween, at least one elongated needle bar extending transversely and movable toward and away from the tufting zone, and having a predetermined number of tufting needles mounted thereon, and a supply of tufting yarn, said tufting machine comprising:

a pattern yarn feed drive assembly supported on the head of the tufting machine with respect to the at least one needle bar, said yarn feed drive assembly having a first yarn drive control section and a separate second yarn drive control section, each said yarn drive control section having a plurality of yarn drive controls about which selected yarns are passed, each said yarn drive control being constructed and arranged to feed the selected ones of the tufting yarns to selected ones of said needles to form multiple repeats of recurring predetermined numbers of yarns in series across the tufting machine for forming the desired graphic pattern; and a yarn feed tube bank for guiding a respective one of the yarns to each needle, respectively, said tube bank having a predetermined number of elongated yarn tubes, one each of said yarn tubes being provided for each one of the needles of the tufting machine;

wherein said tube bank comprises a first tube bank section for guiding the yarns fed by said first yarn drive control section and a separate second tube bank section for guiding the yarns fed by said second yarn drive control section, each said tube bank section being constructed and arranged to guide the yarns to each needle of the multiple repeats extending across the tufting machine with the lengths of the yarns passed therethrough from the respective ones of said yarn drive controls to each needle, respectively, being minimized.

13. The tufting machine of claim 12, wherein said first and said second tube bank sections are identical to and in reverse hand with respect to one another, each said tube bank section having an identical number of said yarn tubes.

14. The tufting machine of claim 12, wherein said first and said second tube bank sections each guides yarns to one-half of said predetermined number of needles.

15. A tufting machine with an improved pattern yarn feed and distribution device used to produce a tufted article having a graphic pattern defined in its face, the tufting machine having an elongate frame, the frame including a base and a head supported on the frame above the base, the head and the base of the tufting machine defining a tufting zone therebetween, at least one elongate needle bar extending in the lengthwise direction of the tufting machine and supported on the head of the tufting machine for reciprocating movement toward and away from the tufting zone, a predetermined number of tufting needles mounted on the at least one needle bar in aligned series and extending at least partially along the length thereof, and a supply of tufting yarn, said tufting machine comprising:

a pattern yarn feed drive assembly supported on the head of the tufting machine with respect to the at least one needle bar, said yarn feed drive assembly including:

i) a plurality of yarn drive controls;

ii) a first center yarn drive control section having a first predetermined number of said yarn drive controls;

iii) a second yarn drive control section positioned at one end of said first yarn drive control section;

iv) a third yarn drive control section positioned at the other one end of said first yarn drive control section and being spaced from said second yarn drive control section;

wherein selected ones of the yarns are selectively passed about said yarn drive controls, each said yarn drive control being constructed and arranged to selectively feed the selected ones of the tufting yarns to selected ones of said needles; and a yarn feed tube bank for guiding a respective one of the yarns to each needle, respectively, said tube bank having a predetermined number of elongate yarn tubes, one each of said yarn tubes being provided for each one of the needles of the tufting machine, said tube bank comprising at least two separate tube bank sections, each of said at least two tube bank sections being constructed separately of the other and also being constructed and arranged to minimize the length of the yarns passed therethrough from respective ones of said yarn drive controls to the needles of the tufting machine.

16. The tufting machine of claim 15, wherein said at least two tube bank sections comprises a first center tube bank section, a second tube bank section at one end of said first tube bank section, and a third tube bank section at the other end of said first tube bank section.

17. The tufting machine of claim 16, wherein said first center tube bank section is constructed and arranged to guide the yarns fed by said first yarn drive control section to the needles of the tufting machine, said second tube bank section is constructed and arranged to guide at least some the yarns of said first yarn drive control section and all of the yarns fed by said second yarn drive control section to the needles of the tufting machine, and said third tube bank section is constructed and arranged to guide at least some the yarns of said first yarn drive control section and all of the yarns fed by said third yarn drive control section to the needles of the tufting machine.

18. The tufting machine of claim 15, wherein said second and said third yarn drive control sections each has a second predetermined number of yarn drive controls which is a fractional number of said first predetermined number of said yarn drive controls.

* * * * *

UNITED STATES PATENT AND TRADEMARK OFFICE

CERTIFICATE OF CORRECTION

PATENT NO. : 5,983,815
DATED : November 16, 1999
INVENTOR(S) : Roy T. Card

It is certified that error appears in the above-identified patent and that said Letters Patent is hereby corrected as shown below:

Column 13,
Lines 47-48, change "length-wise" to -- width-wise --.

Column 14,
Lines 39-40, change "length-wise" to -- width-wise --.

Column 15,
Line 41, change "length-wise" to -- width-wise --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*